US006361711B1

(12) United States Patent
Abe et al.

(10) Patent No.: US 6,361,711 B1
(45) **Date of Patent: *Mar. 26, 2002**

(54) FLAME RETARDANT HYDRAULIC OIL CONTAINING A SYNTHETIC ESTER FORMED BY REACTION OF A POLYOL AND A MIXTURE OF CARBOXYLIC ACIDS INCLUDING OLEIC ACID AND ISOSTEARIC ACID

(75) Inventors: Kazuaki Abe, Sodegaura; Hiromichi Seiki; Mitsuhiro Iwata, both of Ichihara, all of (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 08/489,827

(22) Filed: Jun. 13, 1995

Related U.S. Application Data

(63) Continuation of application No. 08/162,266, filed on Dec. 7, 1993, now abandoned.

(30) Foreign Application Priority Data

Dec. 7, 1992 (JP) ..... 4-326669

(51) Int. Cl.[7] ..... C10M 105/10

(52) U.S. Cl. ..... 252/77; 252/78.1; 252/79; 508/466; 508/469; 508/473; 508/474; 508/485; 508/486

(58) Field of Search ..... 252/565, 56 R, 252/72, 79, 77, 78.1; 508/466, 469, 473, 474, 485, 486

(56) References Cited

U.S. PATENT DOCUMENTS 2,812,342 A * 11/1957 Peters ..... 530/230
3,074,981 A * 1/1963 Aylesworth et al. ..... 560/127
3,986,965 A * 10/1976 Clark et al. ..... 530/230
4,519,932 A * 5/1985 Schnur et al.
4,645,615 A 2/1987 Drake ..... 252/56 R
5,141,663 A 8/1992 Miller

FOREIGN PATENT DOCUMENTS

| | | | |
|---|---|---|---|
| GB | 1354749 | * | 5/1974 |
| GB | 1441918 | * | 7/1976 |
| GB | 2063909 | * | 6/1981 |
| JP | 18 467 | * | 2/1980 |
| WO | 92-22627 | * | 12/1992 |

OTHER PUBLICATIONS

Database WPI, Week 8805, Derwent Publications Ltd., AN 88–032071, Abstract.

* cited by examiner

*Primary Examiner*—Margaret Medley
(74) *Attorney, Agent, or Firm*—Antonelli, Terry, Stout & Kraus, LLP

(57) ABSTRACT

Disclosed herein is a flame retardant hydraulic oil excellent in the flame retardancy, heat stability and oxidative stability, unaccompanied by the dangers of pinhole fire and giving rise to no environmental contamination.

This flame retardant hydraulic oil contains a hydraulic base oil including as the essential component a synthetic ester, which is a product formed by reacting (A) at least one polyol selected from the group consisting of neopentyl glycol, 2,2-dimethyl-3-hydroxypropyl-2',2'-dimethyl-3'-hydroxypropionate, glycerin and trimethylolpropane with (B) a carboxylic acid including 15 to 85% by mole of oleic acid based on the total carboxylic acid and 15 to 85% by mole of isostearic acid based on the total carboxylic acid or a carboxylic acid obtained by incorporating into the carboxylic acid 85% by mole or less of monocarboxylic acid having 6 to 22 carbon atoms (excluding oleic acids and isostearic acids) based on the total carboxylic acid. The synthetic ester has a kinematic viscosity of 40 to 80 cSt at 40° C. and a flash point of 290° C. or higher.

20 Claims, No Drawings

FLAME RETARDANT HYDRAULIC OIL CONTAINING A SYNTHETIC ESTER FORMED BY REACTION OF A POLYOL AND A MIXTURE OF CARBOXYLIC ACIDS INCLUDING OLEIC ACID AND ISOSTEARIC ACID

This application is a Continuation application of application Ser. No. 08/162,266, filed Dec. 7, 1993 now abandoned.

BACKGROUND OF THE INVENTION

1. Field of the Invention

The present invention relates to a flame retardant hydraulic oil to be used in rolling mills, die casting machines and the like in the field of the steel making industry and the nonferrous metal industry and in hydraulic instruments and the like in the construction industry. More particularly, it relates to a flame retardant hydraulic oil excellent in the flame retardancy, heat stability and oxidative stability, unaccompanied by the dangers of pinhole fire at sites of use and giving rise to no environmental contamination.

2. Description of the Related Arts

Generally, it is essential that the flame retardant hydraulic oils have the following characteristics:

(1) the oils are excellent in viscosity-temperature properties to ensure the transmission of pressure and power, (2) the oils have appropriate viscosities to minimize the loss of pressure and power, (3) the oils are excellent in the heat stability, oxidative stability and lubricity to provide the longer service life, (4) the oils are excellent in the demulsibility to protect from the possible mixture of water, and (5) the oils have flash points high enough not to permit the continuous burning even if the oils are ignited, since it is quite likely that the oils are used where there are the high risks of fire.

As these flame retardant hydraulic oils, there have been conventionally used those of emulsion series, those of water-glycol series, those of phosphoric acid ester series, those of fatty acid ester series and the like.

However, the hydraulic oils of emulsion series and those of water-glycol series are low in heat stability, oxidative stability, and lubricity or are difficult to dispose of with waste water.

Furthermore, the hydraulic oils of phosphoric acid ester series have shortcomings in that their viscosity-temperature properties and hydrolytic resistance are deficient, the oils are responsible for the deterioration of seal materials and the exfoliation of coats. Also it is difficult to dispose of waste oils containing such hydraulic oils by burning.

On the other hand, the hydraulic oils of fatty acid ester series are good on the above-mentioned points, having found their application in wide segments of market. But these oils are deficient in the fire resistance and flame retardancy. Various studies have been conducted in an attempt to overcome these problems incidental to the hydraulic oils of fatty acid ester series. In fact, the technique covering the flame retardant oils of fatty acid ester series has been disclosed, for example in Japanese Patent Applications Laid Open No. 18467/1980, No. 226096/1984, No. 125598/1988, No. 214795/1990 and No. 21697/ 1991.

However, all of flame retardant hydraulic oils disclosed in said patent applications have the flame retardancy defined only in terms of flash point. The most important problem of flame retardant hydraulic oils is accidents to be caused by pinhole fire. Specifically, the flame retardant hydraulic oils should have the properties that the oils are hard to catch fire even if the oils are erupted from pinholes and, even in the case of catching fire, do not permit it to develop into the continuous burning if the source of fire is removed. These properties cannot be obtained merely by having the high flash points.

The present inventors have taken note of the properties of continuous burning and conducted the studies by spraying and burning various flame retardant oils under high pressure. The studies have resulted in finding that conventional flame retardant oils of fatty acid ester series (particularly the fatty acid esters made of the oleic acid only) do not have the sufficiently satisfactory flame retardancy, although these oils are highly spoken of as flame retardant.

Thus, the present inventors have made the further intensive studies with a view to developing a flame retardant hydraulic oil of fatty acid ester series free from the properties of continuous burning and excellent in the heat stability, oxidative stability and fluidity. As the results, it has been found that the desired flame retardant hydraulic oil can be obtained by incorporating a fatty acid ester which is formed by reacting a specific polyol with an oleic acid and a isostearic acid or with the oleic acid, the isostearic acid and another monocarboxylic acid in a specific ratio. The present invention has been completed on the basis of this finding.

SUMMARY OF THE INVENTION

Accordingly, an object of the present invention is to provide a flame retardant hydraulic oil containing a hydraulic base oil comprising as the essential component a synthetic ester, which is a product formed by reacting (A) at least one polyol selected from the group consisting of neopentyl glycol, 2,2-dimethyl-3-hydroxypropyl-2',2'-dimethyl-3'-hydroxypropionate, glycerin and trimethylolpropane with (B) a carboxylic acid comprising 15 to 85% by mole of oleic acid based on the total carboxylic acid and 15 to 85% by mole of isostearic acid based on the total carboxylic acid or a carboxylic acid obtained by incorporating into said carboxylic acid 85% by mole or less of monocarboxylic acid having 6 to 22 carbon atoms (provided that the oleic acids and isostearic acids are excluded) based on the total carboxylic acid, said synthetic ester having a kinematic viscosity of 40 to 80 cSt at 40° C. and a flash point of 290° C. or higher.

DESCRIPTION OF THE PREFERRED EMBODIMENTS

The present invention will be described in greater detail hereinafter:

The flame retardant hydraulic oils of the present invention use a hydraulic base oil comprising a fatty acid ester as the essential component. The fatty acid esters of the present invention are a synthetic ester obtained by reacting a polyol of Component (A) with an oleic acid and an isostearic acid of Component (B), or by reacting a polyol of Component (A) with an oleic acid, isostearic acid and a monocarboxylic acid having 6 to 22 carbon atoms (provided that oleic acids and isostearic acids are excluded) of Component (B).

The polyols of Component (A), which are used in the reaction to form the synthetic esters are at least one polyol selected from the group consisting of neopentyl glycol, 2,2-dimethyl-3-hydroxypropyl-2',2'-dimethyl-3'-hydroxypropionate, glycerin and trimethylolpropane. These polyols can be used singly or in their two or more mixture.

On the other hand, the carboxylic acids of Component (B) which are used in the reaction to form the synthetic esters are a carboxylic acid comprising an oleic acid and an isostearic acid as the essential component and further preferably a monocarboxylic acid having 6 to 22 carbon atoms, provided that the oleic acids and isostearic acids are excluded.

Upon their esterification with the polyols of Component (A), the carboxylic acids of Component (B) comprise the oleic acids in a ratio of 15 to 85% by mole to the total carboxylic acid, the isostearic acid in a ratio of 15 to 85% by mole to the total carboxylic acid and the monocarboxylic acid having 6 to 22 carbon atoms in a ratio of 85% by mole or less, preferably 70% by mole or less to the total carboxylic acid, if said monocarboxylic acids are put to use.

If the ratio of the oleic acids in the carboxylic acids is less than 15% by mole, the low fluidity would undesirably result. If it is more than 85% by mole, the flame retardancy would be undesirably deficient. Furthermore, if the ratio of the isostearic acids is less than 15% by mole, the flame retardancy would be undesirably deficient. If it is more than 85% by mole, the fluidity would be undesirably at a low side.

The monocarboxylic acids having 6 to 22 carbon atoms are not particularly limited. Their examples include a straight chain saturated fatty acid such as caproic acid, enanthic acid, caprylic acid, pelargonic acid, capric acid, undecanoic acid, lauric acid, tridecanoic acid, myristic acid, pentadecanoic acid, palmitic acid, heptadecanoic acid, stearic acid, nonadecanoic acid, arachic acid and behenic acid; a straight chain unsaturated fatty acid such as undecenoic acid, elaidic acid, cetoleic acid, erucic acid and brassidic acid; and a branched chain saturated fatty acid such as isomyristic acid, isopalmitic acid, 2,2-dimethylbutanoic acid, 2,2-dimethylpentanoic acid, 2,2-dimethyloctanoic acid, 2-ethyl-2,3,3-trimethylbutanoic acid, 2,2,3,4-tetramethylpentanoic acid, 2,5,5-trimethyl-2-t-butylhexanoic acid, 2,3,3-trimethyl-2-ethylbutanoic acid, 2,3-dimethyl-2-isopropylbutanoic acid, 3,5,5-trimethylhexanoic acid and 2-ethylhexanoic acid. These monocarboxylic acids can be used singly or in a mixture.

With respect to the flame retardant hydraulic oils of the present invention, the hydraulic base oils comprise as the essential component the synthetic esters formed by the ordinary esterification or the transesterification of polyols of Component (A) to carboxylic acids of Component (B).

In the processes wherein the polyols of Component (A) and the carboxylic acids of Component (B) are subjected to the esterification or transesterification, the ratio of the charge of Component (A) to that of Component (B) can be adjusted to obtain the viscosity as desired. Furthermore, it is preferable to remove a fraction of light components to perfection, to provide the flash point of 290° C. or higher.

The thus obtained synthetic esters can be used singly or by mixing the esters to have the viscosity as desired, to serve as the hydraulic base oil.

According to the present invention, the synthetic esters to be used as the hydraulic base oil have the kinematic viscosity of 40 to 80 cSt, preferably 45 to 65 cSt at 40° C. If the viscosity is too high, the low fluidity would result, followed by low efficiency of instruments. If the viscosity is too low, the hydraulic oils are liable to change into a mist and burn when the oils are erupted. It is preferable that the hydraulic oils have the flash point of 290° C. or higher. If the flash point is lower than 290° C., the hydraulic oils are liable to catch fire.

Furthermore, it is preferable that the hydraulic oiles have the iodine value of 65 or lower. The oxidative stability can be shown by such iodine value. Therefore, if the value is higher than 65, the hydraulic oiles are liable to have a larger amount of olefin component and shorter oxidation life, and to burn.

The flame retardant hydraulic oils of the present invention contain the hydraulic base oils comprising the thus obtained synthetic esters as the essential component. Furthermore, it is preferable that said flame retardant hydraulic oils additionally contain a high-molecular compound having a number average molecular weight of 10,000 to 400,000. As the high molecular compound, a polyolefin, a polyacrylate, a polymethacrylate, a polyalkylene glycol, a polyalkylene glycol alkylether, a styrene-olefin copolymer, a styrene-maleic acid ester copolymer, a polyester and the like can be mentioned. Particularly, the methacrylate-based polymers or the styrene-maleic acid ester copolymers are preferably used.

The base oils are made less liable to change into a mist and it is said high molecular compounds which are added thereto so that the mists of base oils are even harder to develop. From this viewpoint, their molecular weights are preferably 10,000 to 400,000. If the molecular weight is smaller than this range, said effect can hardly be obtained undesirably If it is larger than the range, the hydraulic oils are undesirably liable to deteriorate due to the shear when the oils are used, followed by the fadeout of effects and the reduction of viscosity.

In the present invention, it is preferable that said high molecular compounds be contained in the hydraulic oils in a ratio of 0.01 to 2.0% by weight. If the content is smaller than this range, the present invention is hardly effective. If it is larger than this range, the hydraulic oils are more liable to deteriorate due to shear undesirably.

If necessary, the flame retardant hydraulic oils of the present invention may as well be mixed with routinely used lubricating oil additives, such as antioxidant, extreme pressure agent, rust preventives, defoaming agent, demulsifier and the like.

Examples of the antioxidant to be used herein include a phenol-based antioxidant such as 2,6-di-t-butyl-4-methylphenol, 4,4'-methylenebis(2,6-di-t-butyl-4-methylphenol; an amine-based antioxidant such as N-phenyl-α-naphthylamine, N-phenyl-β-naphthylamine, phenothiazine and monooctyldiphenylamine; or a sulfur-based antioxidant such as alkyl disulfide and benzothiazole; and a zinc dialkyldithiophosphate.

Examples of the extreme pressure agent include a zinc dialkyldithiophosphate, a dialkylpolysulfide, a triarylphosphate, a trialkylphosphate and the like.

Examples of the rust preventives include an alkenyl succinate, a sorbitan monooleate, a pentaerythritol monooleate and an aminephosphate.

Examples of the defoaming agent include a dimethylpolysiloxane and a diethylsilicate. Examples of the demulsifier include a polyoxyalkylene glycol, a polyoxyalkylene alkylether, a polyoxyalkylene alkylamide and a polyoxyalkylene fatty acid ester.

It is preferable that the flame retardant hydraulic oils of the present invention as obtained above have the biodegradability of 67% or more as the result of the biodegradation test according to the CEC method.

Obtained as above, the flame retardant hydraulic oils of the present invention are excellent in the flame retardancy, heat stability, oxidative stability and unaccompanied by the dangers of pinhole fire by incorporating the hydraulic base oils which comprise as the essential component the synthetic esters formed by reacting the polyols of Component (A) with the carboxylic acids of Component (B).

Therefore, these flame retardant hydraulic oils can find their application, for example in various hydraulic instruments, construction equipment, injection machines, machine tools, hydraulically driven robots and the like. Furthermore, they can be used as an engine oil, a gear oil, an industrial lubricating oil for other uses and the like.

Moreover, the oils are biodegradable, capable of finding the application as a lubricating oil preferable from the viewpoint of environmental protection.

Now the present invention will be described in greater specific details, which should not be construed as limiting the claimed scope of the present invention to the details of these examples.

Example 1

A Dean and Stark water separator equipped with a stirrer, a thermometer, a argon gas blower and a condenser was joined to a four neck flask having an internal volume of 5 liter. Into this flask, 603 g (4.5 mole) of a trimethylolpropane, 2,822 g (8.8 mole) of an oleic acid and 99.9 g (3.5 mole) of an isostearic acid were charged. Then, the mixture was subjected to the esterification, heated by a mantle heater in a stream of argon. At the time when the inside temperature arose to 160° C. (about 1 hour), water started distilling off. The temperature was elevated step by step, and 240 ml of water was collected in a trap within approximately 3 hours. Thereupon, the inside temperature was 240° C. Furthermore, the temperature was raised to 260° C., and the distill and was stirred with heating for 3 hours, to complete the reaction.

Thereafter, the water separator was replaced by a distillation head, and a fraction of light components was distilled off at 260° C. under reduced pressure (2mm Hg) for 3 hours.

Thus, 4,092 g of a fatty acid ester was obtained.

Examples 2 to 5 & Comparative Examples 1 to 4

Examples 2 to 5 and Comparative Examples 1 to 4 were carried out by repeating the esterification of Example 1 except that each component was replaced by that listed in Table 1, to prepare each corresponding ester.

With respect to each fatty acid ester obtained in Examples 1 to 5 and Comparative Examples 1 to 4, the determination of various properties, the test of burning high-pressure spray and the biodegradation test were conducted to assess the quality of said ester.

The results are shown in Table 1.

TABLE 1

| | Fatty acid ester (molar ratio) | | Kinematic viscosity |
|---|---|---|---|
| | Polyol | Carboxylic acid | (cSt) 40° C. |
| Example 1 | TMP (1.0) | Oleic acid (2.22)<br>Isostearic acid (0.78) | 54.95 |
| Example 2 | ESG (1.0) | Oleic acid (0.14)<br>Isostearic acid (1.6) | 54.67 |
| Example 3 | glyc (1.0) | Oleic acid (1.71)<br>Isostearic acid (1.29) | 55.02 |
| Example 4 | NPG (0.62)<br>TMP (0.38) | Oleic acid (0.38)<br>Isostearic acid (2.00) | 57.65 |
| Example 5 | TMP (1.0) | Oleic acid (2.1)<br>Isostearic acid (0.5)<br>Trimethyl hexanoic acid (0.4) | 57.88 |
| Comparative Example 1 | TMP (1.0) | Oleic acid (3.0) | 53.30 |
| Comparative Example 2 | | Quintolubric*1 | 55.30 |
| Comparative Example 3 | glyc (1.0) | Oleic acid (3.0) | 38.24 |
| Comparative Example 4 | ESG (1.0) | Oleic acid (2.0) | 33.72 |

*1Commercially available (produced by Quaker Chemical Corp.)

| | Life of oxidation 150° C. (min) | Iodine value | Flash point (° C.) | Continuous burning time (second) |
|---|---|---|---|---|
| Example 1 | 562 | 61 | 300 | 19 |
| Example 2 | 1,052 | 14 | 294 | 20 |
| Example 3 | 682 | 49 | 310 | 24 |
| Example 4 | 1,562 | 13 | 304 | 20 |
| Example 5 | 571 | 61 | 308 | 18 |
| Comparative Example 1 | 220 | 82 | 308 | 30< |
| Comparative Example 2 | 192 | 82 | 294 | 30< |
| Comparative Example 3 | 88 | 86 | 310 | 30< |
| Comparative Example 14 | 202 | 69 | 302 | 30< |

The abbreviations in the table represent:

TMP: Trimethylolpropane

ESG: 2,2-dimethyl-3-hydroxypropyl-2',2'-dimethyl-3'-hydroxypropionate

NPG: Neopentylglycol glyc: Glycerin

As shown in table 1, the continuous burning time as determined by the high-pressure spray burning test was found to be very short in Examples 1 to 5, and it is clear that their fatty acid esters are excellent in the flame retardancy. On the other hand, all of the fatty acid esters of Comparative Examples 1 to 4 were found to have "the properties of continuous burning," proving that those as defined merely by high flash point cannot have a sufficiently acceptable flame retardancy On the other hand, the biodegradation tests according to the CEC method resulted in the finding that all of the fatty acid esters obtained in Examples 1 to 5 had the biodegradability of 99% or higher.

Meanwhile, the determination of various properties and the high-pressure spray burning test were conducted in the manner mentioned as below:

1) Kinematic viscosity
   Determined in accordance with JIS K-2283.
2) Oxidative stability
   The life of oxidation was determined as directed by the oxidative stability test of rotary cylinder type provided for in JIS K-2514, para. 3.3 and under the conditions of test temperature of 150° C.

Furthermore, this oxidative stability tests used test sample oils which were mixed with 1% by weight of N-phenyl-α-naphthylamine as the additive, except for Comparative Example 2.

3) Iodine value
   Determined in accordance with JIS K-0070.
4) Flash point
   Determined in accordance with JIS K-2274 by using the Cleveland open-cup flash point test (COC).

5) High-pressure spray burning test

The test sample oils were sprayed under high pressure, ignited by a burner and subjected to the preliminary burning for 10 seconds. Then, the flame of burner was extinguished, and the continuous burning time thereafter was determined, to provide an indicator of flame retardancy. If the test sample oils were found to continue burning for more than 30 seconds, the tests were discontinued thereupon and it was decided that the oils are "the properties of continuous burning."

Test conditions:

Spraying pressure: 70 $Kg/cm^2G$(applying the pressure by the use of nitrogen)

Temperature of the test sample oils: 60 ° C.

Nozzle: Monarch 60 ° PL2.25 (of hollow cone type)

Distance between the nozzle and the burner: 10 cm

Preliminary burning time: 10 seconds

Internal volume of the autoclave: 1 liter

6) Biodegradation test

Determined as directed by CEC-L-33-T-82 according to the CEC method.

Examples 6 to 12

The high-pressure spray burning tests were conducted by using the fatty esters obtained in Examples 1, 2 or 3 to which high molecular compounds listed in Table 2 were added and repeating the procedure of Example 1. The results thereof are shown in Table 2.

TABLE 2

| | Fatty acid ester base oil (molar ratio) | | High molecular |
|---|---|---|---|
| | Example No. | Composition | compound |
| Example 6 | 1 | TMP (1.0)<br>Oleic acid (2.22)<br>Isostearic acid (0.78) | Polymethacrylate* |
| Example 7 | 1 | TMP (1.0)<br>Oleic acid (2.22)<br>Isostearic acid (0.78) | Styrene-maleic acid ester copolymer |
| Example 8 | 2 | ESG (1.0)<br>Oleic acid (0.14)<br>Isostearic acid (1.6) | Polymethacrylate* |
| Example 9 | 2 | ESG (1.0)<br>Oleic acid (0.14)<br>Isotearic acid (1.6) | Styrene-isoprene copolymer |
| Example 10 | 3 | glyc (1.0)<br>Oleic acid (1.71)<br>Isostearic acid (1.29) | Styrene-maleic acid ester copolymer |
| Example 11 | 3 | glyc (1.0)<br>Oleic acid (1.71)<br>Isostearic acid (1.29) | Polymethacrylate* |
| Example 12 | 3 | glyc (1.0)<br>Oleic acid (1.71)<br>Isostearic acid (1.29) | Polypropylene glycol dimethylether |

*The polymethacrylate is a copolymer of alkyl having 1 carbon atom to alkyl having 12 carbon atoms.

| | Number average molecular weight | Amount of addition (wt. %) | Continuous burning time (second) |
|---|---|---|---|
| Example 6 | 140,000 | 1.1 | 1 |
| Example 7 | 300,000 | 0.4 | 1 |
| Example 8 | 140,000 | 1.4 | 1 |
| Example 9 | 300,000 | 0.2 | 2 |
| Example 10 | 300,000 | 0.4 | 1 |
| Example 11 | 140,000 | 1.3 | 1 |
| Example 12 | 30,000 | 0.5 | 5 |

As evident from Table 2, it was found that the continuous burning time was made shorter by far due to the addition of high/molecular compounds to fatty ester base oils.

What is claimed is:

1. A flame retardant hydraulic oil containing a hydraulic base oil comprising a synthetic ester, which is a product formed by reacting (A) at least one polyol selected from the group consisting of neopentyl glycol, 2,2-dimethyl-3-hydroxypropyl-2',2'-dimethyl-3'-hydroxypropionate, glycerin and trimethylolpropane with (B) a carboxylic acid comprising 15 to 85% by mole of oleic acid based on the total carboxylic acid and 15 to 85% by mole of isostearic acid based on the total carboxylic acid, said synthetic ester having a kinematic viscosity of 40 to 80 cSt at 40° C. and a flash point of 290° C. or higher.

2. The flame retardant hydraulic oil as set forth in claim 1, wherein the carboxylic acid of Component (B) further contain 85% by mole or less of a monocarboxylic acid having 6 to 22 carbon atoms (excluding the oleic acid and the isostearic acid), based on the total carboxylic acid.

3. The flame retardant hydraulic oil as set forth in claim 1, having an iodine value of 65 or lower.

4. The flame retardant hydraulic oil as set forth in claim 1, further containing 0.01 to 2.0% by weight of a high molecular compound having a number average molecular weight of 10,000 to 400,000.

5. The flame retardant hydraulic oil as set forth in claim 4, wherein the high molecular compound is selected from the group consisting of polymethacrylate-based polymer and styrene-maleic acid ester copolymer.

6. The flame retardant hydraulic oil as set forth in claim 1, having a biodegradability of 67% or higher as the result of a biodegradation test according to the CEC method.

7. The flame retardant hydraulic oil as set forth in claim 2, having a biodegradability of 67% or higher as the result of a biodegradation test according to the CEC method.

8. The flame retardant hydraulic oil as set forth in claim 3, having a biodegradability of 67% or higher as the result of a biodegradation test according to the CEC method.

9. The flame retardant hydraulic oil as set forth in claim 4, having a biodegradability of 67% or higher as the result of a biodegradation test according to the CEC method.

10. The flame retardant hydraulic oil as set forth in claim 5, having a biodegradability of 67% or higher as the result of a biodegradation test according to the CEC method.

11. A flame retardant hydraulic oil containing a hydraulic base oil consisting essentially of a synthetic ester, which is a product formed by reacting (A) at least one polyol selected from the group consisting of neopentyl glycol, 2,2-dimethyl-3-hydroxypropyl-2',2'-dimethyl-3'-hydroxypropionate, glycerin and trimethylolpropane with (B) a carboxylic acid comprising 15 to 85% by mole of oleic acid based on the total carboxylic acid and 15 to 85% by mole of isostearic acid based on the total carboxylic acid, said synthetic ester having a kinematic viscosity of 40 to 80 cSt at 40° C. and a flash point of 290° C. or higher.

12. The flame retardant hydraulic oil as set forth in claim 11, wherein the carboxylic acid of Component (B) further contain 85% by mole or less of a monocarboxylic acid having 6 to 22 carbon atoms (excluding the oleic acid and the isostearic acid), based on the total carboxylic acid.

13. The flame retardant hydraulic oil as set forth in claim 11, having an iodine value of 65 or lower.

14. The flame retardant hydraulic oil as set forth in claim 11, further containing 0.01 to 2.0% by weight of a high-molecular compound having a number average molecular weight of 10,000 to 400,000.

15. The flame retardant hydraulic oil as set forth in claim 14, wherein the high-molecular compound is selected from the group consisting of polymethacrylate-based polymer and styrene-maleic acid ester copolymer.

16. The flame retardant hydraulic oil as set forth in claim 11, having the biodegradability of 67% or higher as the result of a biodegradation test according to the CEC method.

17. The flame retardant hydraulic oil as set forth in claim 12, having the biodegradability of 67% or higher as the result of a biodegradation test according to the CEC method.

18. The flame retardant hydraulic oil as set forth in claim 13, having the biodegradability of 67% or higher as the result of a biodegradation test according to the CEC method.

19. The flame retardant hydraulic oil as set forth in claim 14, having the biodegradability of 67% or higher as the result of a biodegradation test according to the CEC method.

20. The flame retardant hydraulic oil as set forth in claim 15, having the biodegradability of 67% or higher as the result of a biodegradation test according to the CEC method.

* * * * *